United States Patent [19]

Asche

[11] Patent Number: 5,009,566

[45] Date of Patent: Apr. 23, 1991

[54] RETRACTABLE BOOM STOP

[75] Inventor: James E. Asche, Milnor, N. Dak.

[73] Assignee: Clark Equipment Company, Milnor, N. Dak.

[21] Appl. No.: 425,648

[22] Filed: Oct. 20, 1989

[51] Int. Cl.[5] ..... B66C 23/00; E02F 3/80

[52] U.S. Cl. ..... 414/722; 92/23; 414/685

[58] Field of Search ..... 414/680, 685, 695.5, 414/697, 722, 743, 719, 673; 92/14, 15, 16, 17, 18, 19, 20, 23, 25; 212/222; 72/466, 481; 187/8.47, 8.49; 182/230

[56] References Cited

U.S. PATENT DOCUMENTS

| | | | |
|---|---|---|---|
| 3,123,223 | 3/1964 | Markwardt et al. | 212/59 |
| 3,433,367 | 3/1969 | Novotny et al. | 212/39 |
| 3,456,810 | 7/1969 | Ely | 212/39 |
| 3,561,610 | 2/1971 | Buckert et al. | 212/39 |
| 3,647,087 | 3/1972 | Mooney | 212/59 |
| 3,662,653 | 5/1972 | Carlson et al. | 92/15 |
| 3,982,648 | 9/1976 | Luedtke et al. | 214/776 |
| 4,003,474 | 1/1977 | Mooney | 212/59 |
| 4,005,780 | 2/1977 | Morrow, Sr. et al. | 212/8 |
| 4,039,093 | 8/1977 | Schmitz, Jr. et al. | 214/130 |
| 4,043,253 | 8/1977 | Albright et al. | 92/35 |
| 4,078,668 | 3/1978 | Hohmann | 212/39 |
| 4,189,278 | 2/1980 | Dewey | 414/413 |
| 4,201,509 | 5/1980 | Hansen | 414/694 |
| 4,236,864 | 12/1980 | Couture et al. | 414/699 |
| 4,270,663 | 6/1981 | Berger | 212/222 |
| 4,352,626 | 10/1982 | Frisbee et al. | 414/722 |
| 4,389,153 | 6/1983 | Pedersen et al. | 414/695 |
| 4,639,182 | 1/1987 | Inaba et al. | 414/543 |

*Primary Examiner*—David A. Bucci
*Assistant Examiner*—James T. Eller, Jr.
*Attorney, Agent, or Firm*—Kinney & Lange

[57] ABSTRACT

A retractable boom stop includes a channel shaped stop member mounted for pivotal and rectilinear movement relative to the boom arm of a skid steer vehicle. The stop member is movable between an inoperative position adjacent the boom arm and an operative position interposed between the boom arm and lift cylinder. In the operative position the stop member prevents an extensible rod of the lift cylinder from retracting to lower the boom arm. The stop member is secured in the inoperative and operative positions by a retaining pin. A tension spring carried by the stop member and releasably securable to the boom arm automatically retracts the stop member out of the operative position to allow the lift cylinder to be retracted.

20 Claims, 6 Drawing Sheets

10
12
14
16
18
18
20
22
24
26
28
30
32
34
38
40
46
47
48
50
52
56
61
64
66
68
72
76
78
80
81
82
83
2
2

RETRACTABLE BOOM STOP

BACKGROUND OF THE INVENTION

1. Field of the Invention

This invention pertains to a stop for use with an extensible hydraulic cylinder. Particularly, the invention is a retractable boom stop for use with a boom arm lift cylinder of a skid steer vehicle.

2. Description of the Prior Art

Boom stops for the lift cylinders on an off road vehicle are in widespread use. A typical stop member for a lift cylinder is disclosed in the Luedtke et al. U.S. Pat. No. 3,982,648. This stop member is pivotally attached at one end to the boom arm of the vehicle by a pivotable link assembly. To retain the lift cylinder in an extended state the opposite end of the stop member is engaged with a forward end of the lift cylinder body. Once engaged any retraction of the lift cylinder causes the stop member to be wedged between the pivotable link assembly and forward end of the lift cylinder body. To disengage the stop member requires that the lift cylinder be extended and the stop member be manually moved to an inoperative position.

The Albright et al. U.S. Pat. No. 4,043,253 discloses a boom stop for the lift cylinder of an off road vehicle that is pivotally mounted at one end to the boom arm pivot mount for the lift cylinder extensible rod. The boom stop includes a body portion that rests on the lift cylinder body when the lift cylinder is in a retracted state. As the lift cylinder is extended the boom stop rides along the body of the lift cylinder until the opposite end of the boom stop engages the forward end of the cylinder body. Retracting the lift cylinder causes the boom stop to be wedged between the forward end of the cylinder body and the pivot mount for the extensible rod. The boom stop includes a pivotable toggle having a ramped surface that disengages the boom stop from the lift cylinder. Extension followed by retraction of the lift cylinder rotates the toggle to allow the ramped surface to ride over the outer end of the lift cylinder body and thereby disengage the boom stop. This boom stop cannot be moved to an inoperative position adjacent the boom arm. Therefore, it can interfere with the normal operation of the boom arm since the boom stop operates automatically when the lift cylinder is extended.

It is evident that there is a continuing need for improved boom stops for lift arms. Specifically, a retractable boom stop is needed that automatically disengages from its operative state and does not interfere with the normal operation of the boom arms of the off road vehicle.

SUMMARY OF THE INVENTION

The present invention is a the boom stop which can be conveniently operated by one person. The retractable boom stop comprises a channel shaped stop member including a hook shaped extension. The hook shaped extension is engageable with a retaining bolt on the boom arm to permit pivotal and rectilinear movement of the stop member.

The stop member is securable in a stored inoperative position adjacent the boom arm by a U-shaped retaining pin. Once the retaining pin is removed the stop member rests on the body of the retracted lift cylinder. Extending the lift cylinder allows the stop member to ride along the lift cylinder until a first end of the stop member engages a forward end of the lift cylinder body. Retracting the lift cylinder causes the hook shaped extension to ride along the retaining bolt until a second end of the stop member engages a portion of the boom arm thereby defining the operative position of the stop member. Any further retraction of the lift cylinder further wedges the stop member between the forward end of the lift cylinder body and the boom arm, thereby preventing the lift cylinder from being retracted.

The stop member includes a pair of stop tabs at the first end that engage the edge of the lift cylinder body to maintain the stop member in the operative position. The retaining pin is further used to secure the stop member to the lift cylinder by trapping the lift cylinder extensible rod within the body of the stop member.

The stop member carries a tension spring attached at one end to the first end of the stop member. To disengage the stop member from its operative position the second end of the spring is releasably attached to the boom arm and the retaining pin is removed. Extending the lift cylinder allows the tension spring to automatically retract the stop member from the operative position out of engagement with the lift cylinder. The lift cylinder can then be returned to its retracted state.

The stop member is stored in its inoperative position by detaching the second end of the spring from the boom arm and inserting the retaining pin to secure the stop member adjacent to the boom arm. The spring is stored by attaching the second end to the retaining pin. In the operative position of the stop member the second end of the tension spring is attached to a portion of the stop member body.

This retractable boom stop is relatively uncomplicated and since it can be stored in an inoperative position does not interfere with the normal operations of the boom arms. In addition, it does not require manual input to remove it from the operative position.

DETAILED DESCRIPTION OF THE PREFERRED EMBODIMENTS

Figure 1:
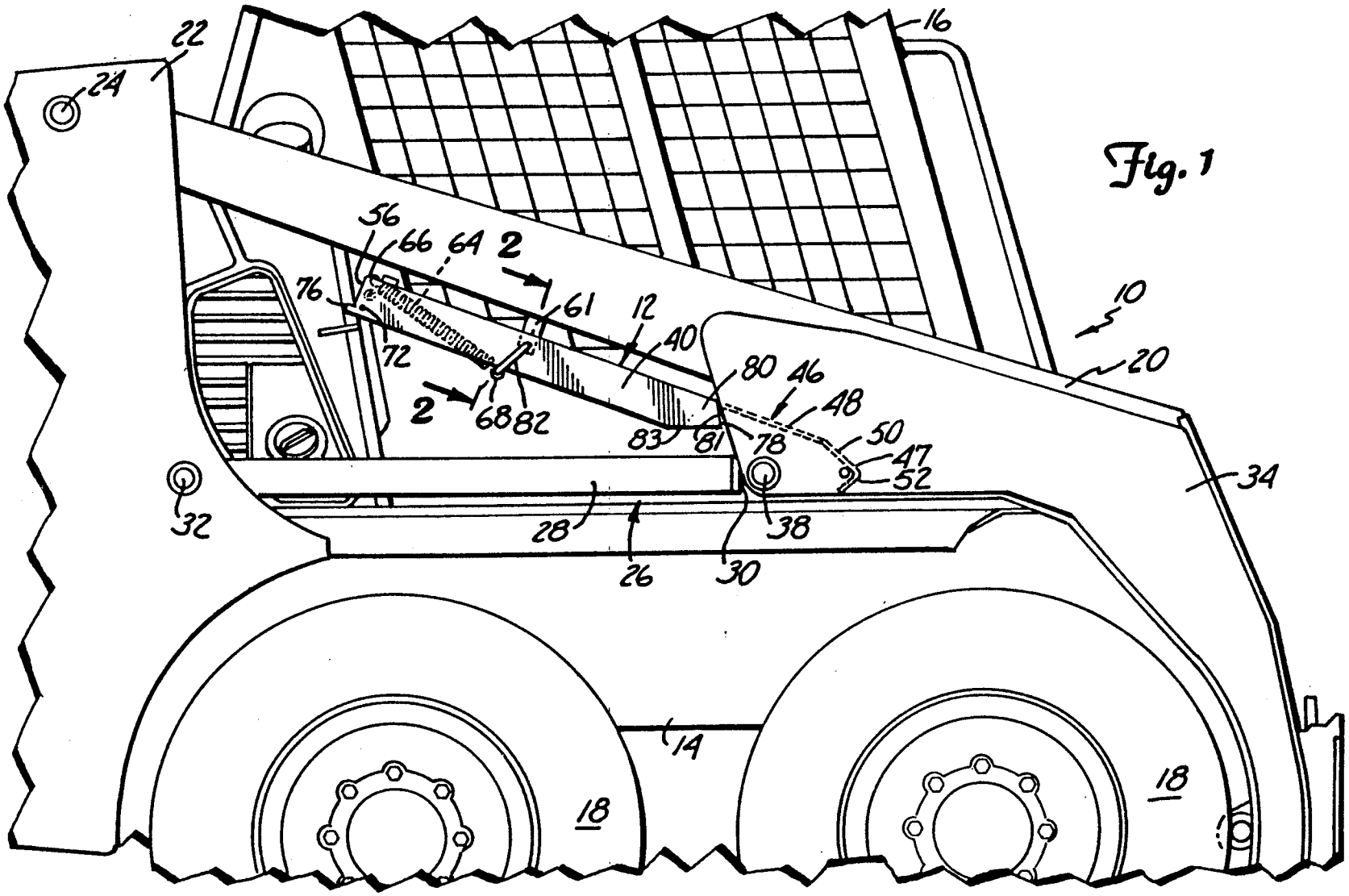
FIG. 1 is a side elevational view of a skid steer vehicle incorporating the stop member of the present invention, with the lift cylinders of the vehicle in a retracted position and the stop member in an inoperative, stored relationship relative thereto.

A skid steer vehicle 10 which includes a boom stop 12 in accordance with the present invention is illustrated generally in FIG. 1. Vehicle 10 includes a main frame 14 having an operators cab 16. Vehicle 10 is supported for over the ground travel by wheels 18 rotatably mounted to frame 14. Motive force for wheels 18 is provided by a hydrostatic drive system (not shown) mounted to the frame 14 and controlled by an operating unit (not shown) mounted within cab 16.

Main frame 14 includes boom arms 20 pivotally mounted to upright supports 22 by way of a pivotal connection 24. A lift cylinder 26 is provided on each side of the vehicle to raise the boom arms 20. Each lift cylinder 26 comprises a cylinder body 28 and an extensible rod 30. A pivot mount 32 pivotally connects cylinder body 28 to the upright supports 22.

Figure 5:
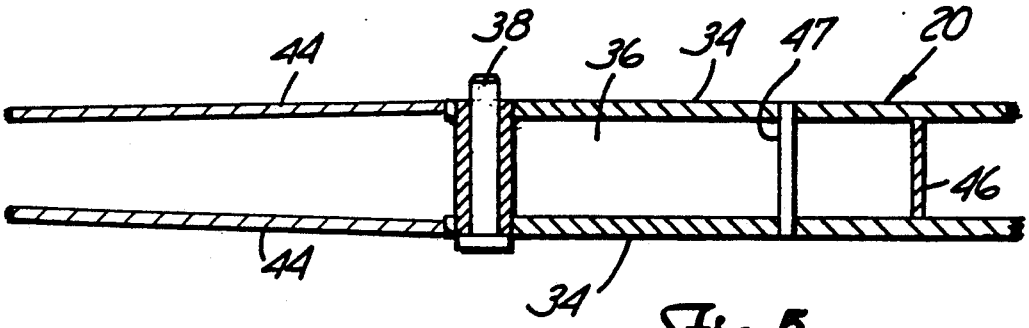
FIG. 5 is an elevational cross sectional view taken along line V—V in FIG. 6B showing the retaining bolt of the boom arm with the lift cylinder removed.

As shown in FIGS. 1 and 5, each boom arm 20 includes a pair of curved front portions 34 that form a gap 36 therebetween. A pivot mount 38 pivotally connects the extensible rod 30 to the curved front portion 34 within the gap 36. Pivotally mounted at the lower end of the curved front portions 34 of the boom arms 20 is a bucket (not shown) controlled by a tilt cylinder (not shown).

Figures 2, 3, 4:
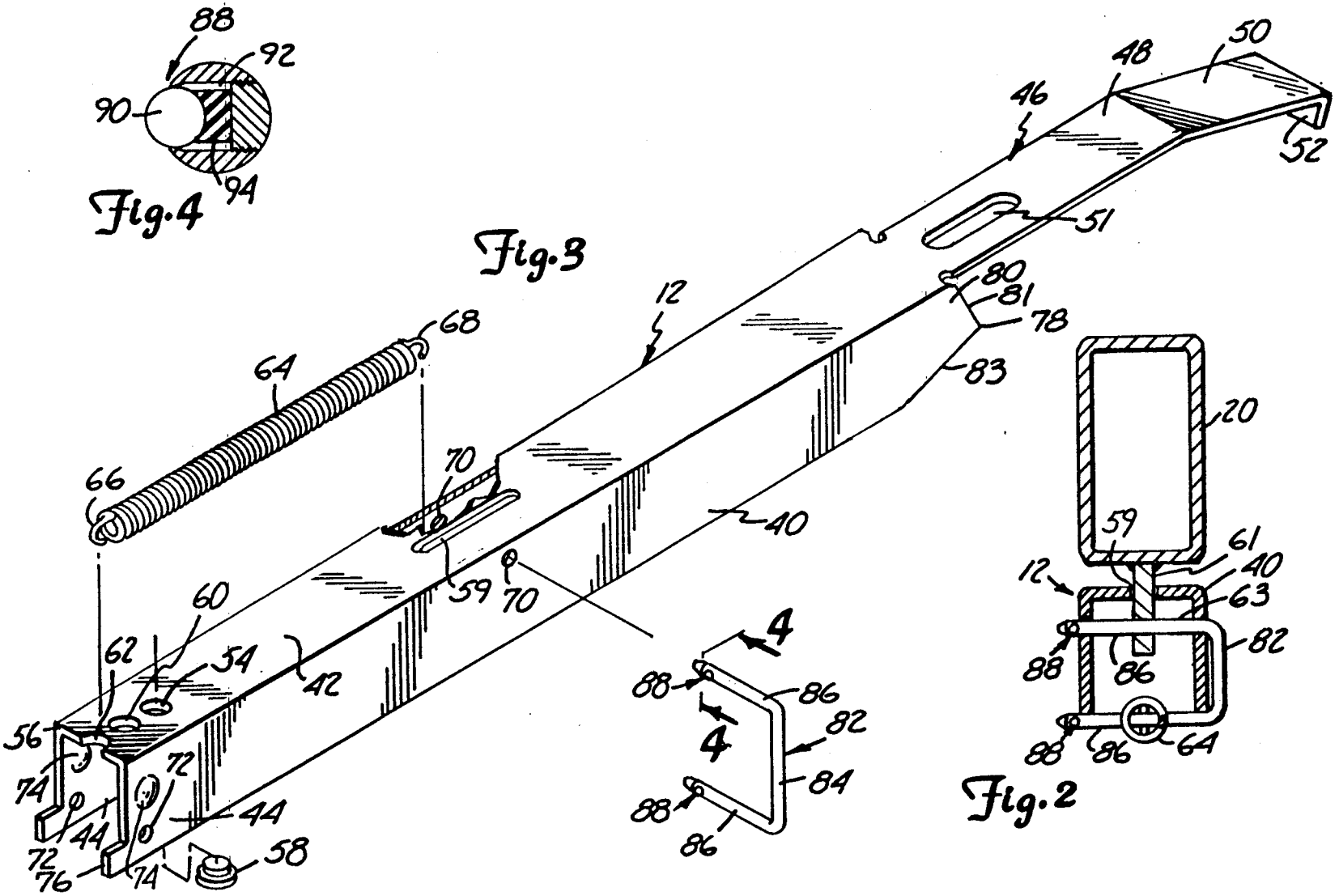
FIG. 2 is an elevational cross sectional view taken along line II—II in FIG. 1, showing the retaining pin securing the stop member in the inoperative stored position.
FIG. 3 is a perspective view of the stop member removed from the vehicle with various components shown exploded therefrom.
FIG. 4 is an enlarged cross sectional view taken along line IV—IV in FIG. 3, showing the resiliently biased ball detent incorporated in the legs of the retaining pin.

As shown in FIG. 3, stop member 12 includes a channel shaped body 40 having a base portion 42 and outwardly extending side walls 44. The base portion 42 includes a hook shaped extension 46 having a first portion 48 integral with the base portion 42. The hook shaped extension 46 further includes a first angled portion 50 integral with the first portion 48 and a second angled portion 52 integral with and perpendicular to the first angled portion 50. A large elongated slot 51 is provided in first portion 48 to accommodate a grease fitting (not shown) associated with the boom arm 20. The stop member 12 is supported for pivotal and rectilinear movement by a retaining bolt 47 (see FIG. 1) engaged by the angled portions 50 and 52 of the hook shaped extension 46.

The base portion 42 further includes a first aperture 54 near a first end 56 of stop member 12. A resilient bumper 58 is mounted in first aperture 54 and prevents damage to the extensible rod 30 when the first end 56 of stop member 12 engages a forward end 96 of cylinder body 28. A second aperture 60 is located adjacent to the first aperture 54 and a semicircular notch 62 is located adjacent to the second aperture 60 at the edge of the base portion 42. The base portion 42 also includes a narrow elongated slot 59 that receives a boom arm mounting tab 61 having a through aperture 63.

Tension spring 64 having first and second ends 66 and 68 is carried by the stop member 12. The first end 66 of the spring 64 is received by the notch 62 and second aperture 60 so that the spring 64 can be rotated from within the channel shaped body 40 of the stop member 12 (see FIG. 1) to the exterior thereof.

The side walls 44 include a first pair of aligned openings 70 located at the median of the stop member 12. A second pair of aligned openings 72 are located at the first end 56 of stop member 12. Adjacent each opening 72 of the second pair of aligned openings is a dimple 74 and a stop tab 76 whose purpose will be explained later. The side walls 44 at second end 78 of the stop member 12 include integral stop ears 80 defined by first and second sloped portions 81 and 83. As shown in FIG. 5, the side walls 44 at the second end 78 of the stop member 12 are spaced apart by a distance greater than that at the first end 56. The wider spacing allows the stop ears 80 to engage the curved front portions 34 of boom arm 20 in the operative position of the stop member 12. The stop member 12 further includes a U-shaped retaining pin 82 having a bight 84 and outwardly extending legs 86. As shown in FIG. 4, the free end of each leg includes a resiliently biased ball detent 88 that includes a ball 90 received within an aperture 92 and biased by a resilient member 94.

OPERATION OF THE PREFERRED EMBODIMENT

FIGS. 1 and 2 show the stop member 12 in a stored inoperative position. Tab 61 of the boom arm 20 is engaged through narrow elongated slot 59. One of the legs 86 of the retaining pin 82 is inserted through the first pair of aligned openings 70 and the aperture 63 of the tab 61 to secure the stop member 12. The resiliently biased ball detent 88 on leg 86 helps prevent retaining pin 82 from being inadvertently dislodged. Tension spring 64 is shown stored within the channel shaped body 44 of the stop member 12. The second end 68 of the spring 64 is attached to the unused leg 86 of the retaining pin 82 to thereby secure the tension spring 64 in place.

Figure 6A:
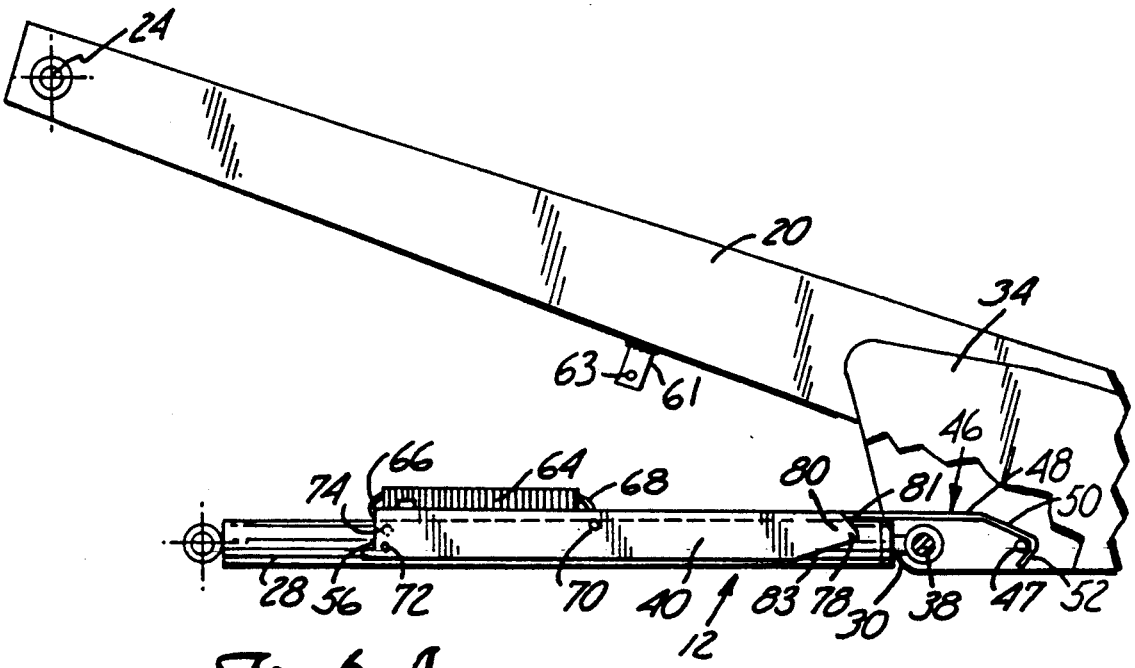
FIGS. 6A–6D are side elevational position views showing the stop member in various orientations relative to the lift cylinders of the vehicle.

To operate the stop member 12, the retaining pin 82 is removed from the aperture 63 and the first pair of aligned openings 70, thereby releasing the stop member 12 from the boom arm 20 and the second end 68 of the spring 64 from the retaining pin 82. The spring 64 is rotated from within the channel shaped body 44 of the stop member 12 to the exterior of the base portion 42. The second end 68 of the tension spring 64 is engaged with the narrow elongated slot 59 that was just vacated by the boom arm tab 61. The stop member 12 is then allowed to rest on the cylinder body 28 as shown in FIG. 6A.

The retracted lift cylinder 26 is extended, raising the boom arm 20 while retaining bolt 47 draws the stop member 12 along the lift cylinder body 28 until the first end 56 engages the forward end 96 of the lift cylinder body 28. The lift cylinder 26 is then retracted causing the first angled portion 50 to ride along the retaining bolt 47 until the first sloped portion 81 of stop ears 80 engage the curved front portions 34 of the lift arm 20. The stop member is now in the operative position and thereby prevents retraction of the lift cylinder 26.

Figure 6B:
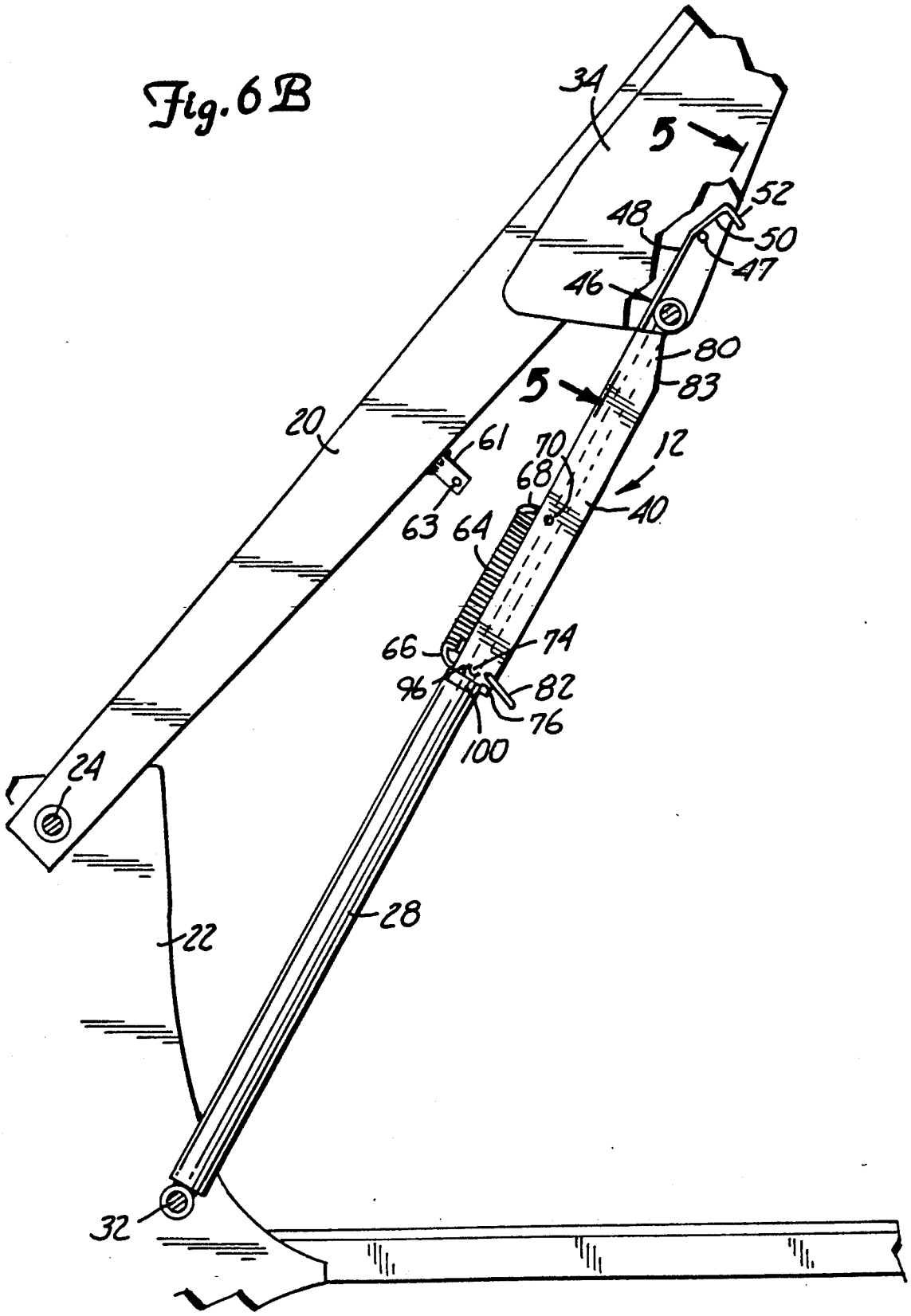

FIG. 6B further shows the stop tabs 76 of the side walls 44 engaged with a side edge 100 of the lift cylinder body 28. The stop tabs 76 help prevent the stop member 12 from becoming inadvertently dislodged from the lift cylinder body 28. One of the legs 86 of the retaining pin 82 is inserted through the second pair of aligned openings 72, thereby trapping the extensible rod 30 of the lift cylinder 26 within the channel shaped body 44 of the stop member 12. Dimples 74 act to align stop member 12 relative to the extensible rod 30.

Figure 6C:
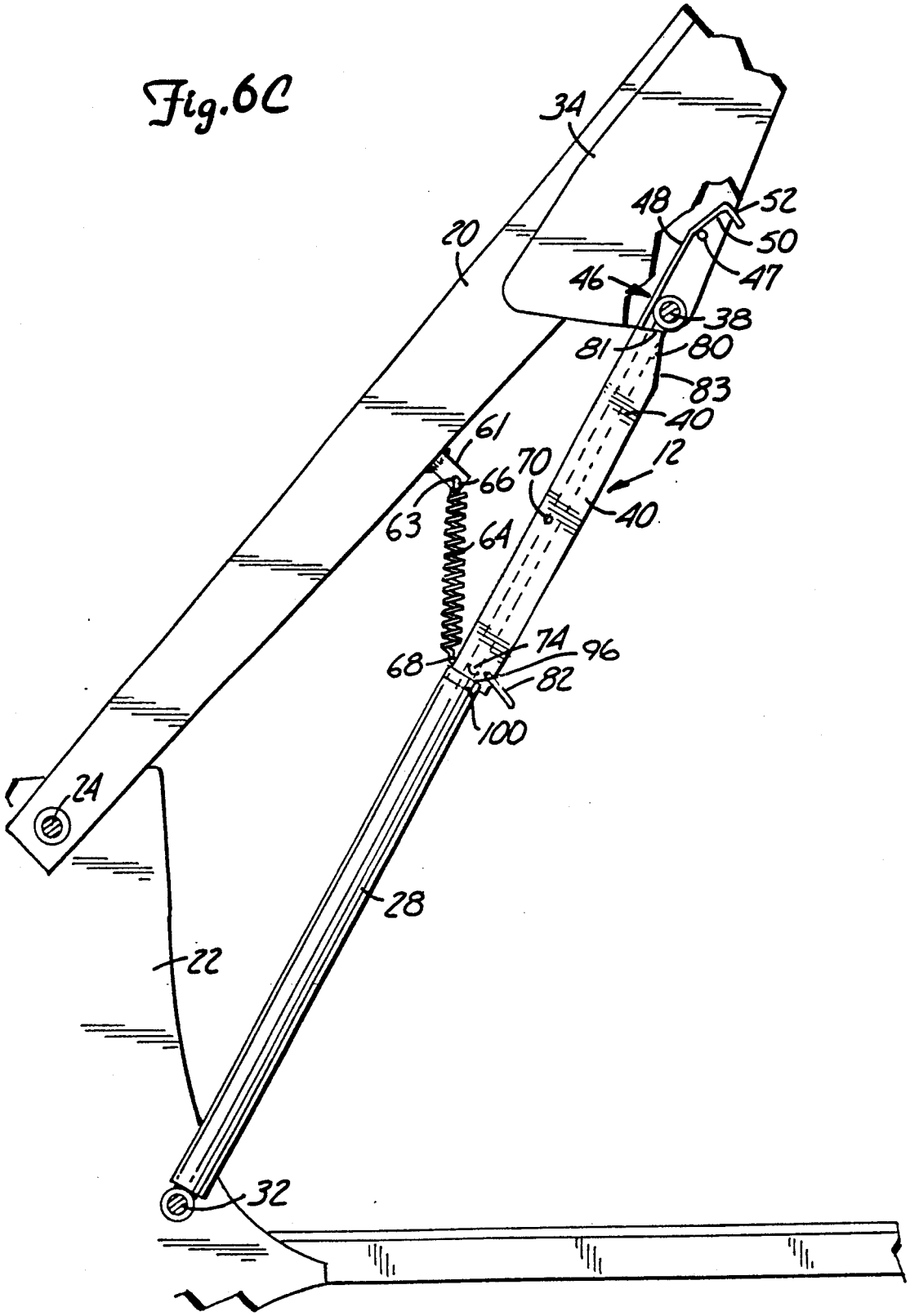
Figure 6D:
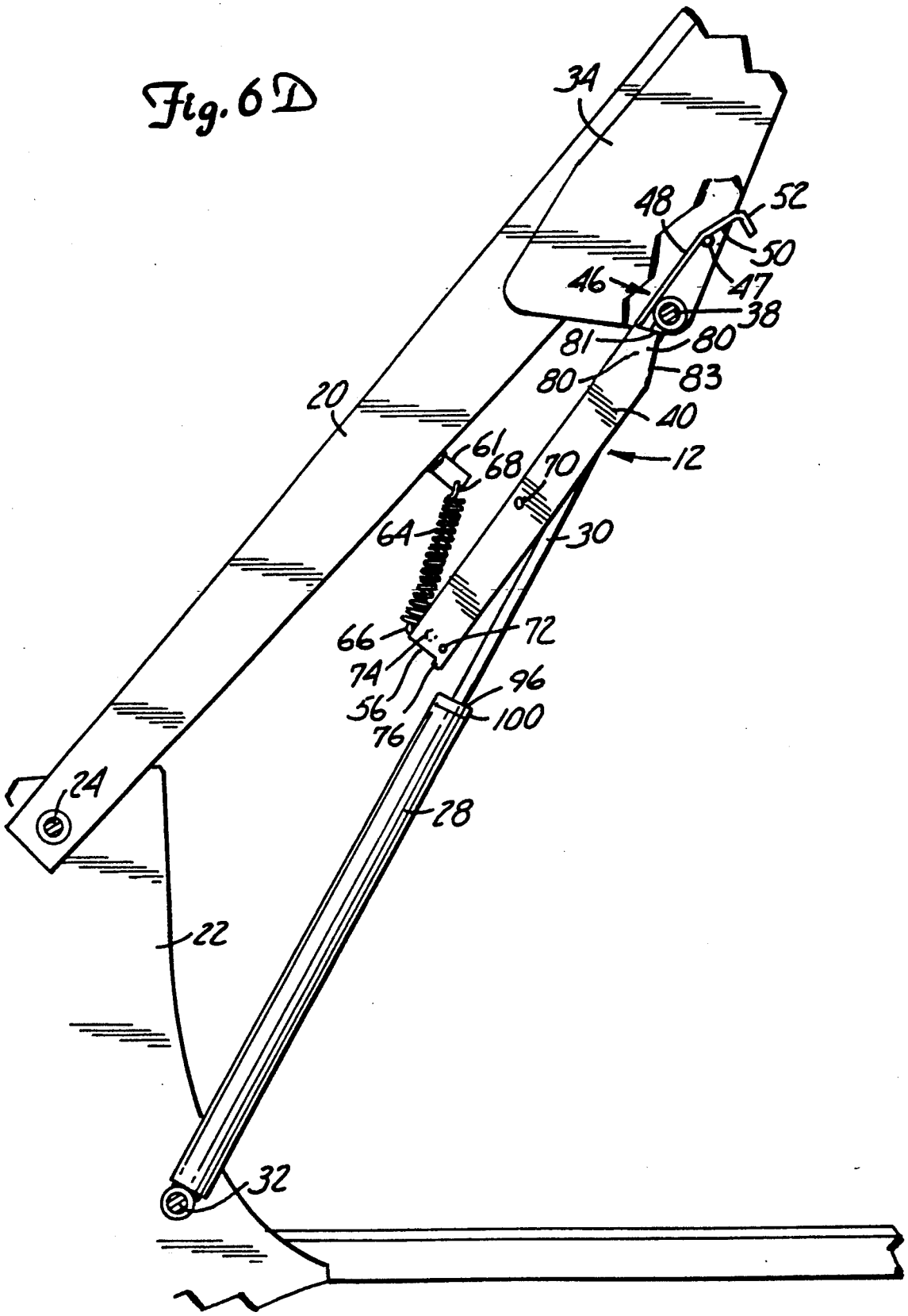

As shown in FIG. 6C, when it is desired to remove the stop member 12 from the engaged operative position the second end 68 of the tension spring 64 is removed from the narrow elongated slot 59 of the base portion 42 of the stop member 12. The second end 68 of the spring 64 is then attached to the aperture 63 of the boom arm tab 61. The retaining pin 82 is subsequently removed from the second pair of aligned openings 72. Further extension of the lift cylinder 26 allows the tension spring 64 to automatically retract the stop member 12 from the operative position as shown in FIG. 6D. With the stop member 12 disengaged, the lift cylinder 26 can then be fully retracted as shown in FIG. 1.

To store the stop member 12 in the inoperative position the second end 68 of tension spring 64 is removed from aperture 63 of the boom tab 61. The spring 64 is rotated from the exterior of the stop member 12 to within the channel shaped body 44. Stop member 12 is pivoted about the retaining bolt 47 allowing the tab 61 to extend through the narrow elongated slot 59 in the base portion 42. A leg 86 of the retaining pin 82 is inserted through the first pair of aligned apertures 70 and through the aperture 63 of the tab 61. The second end 68 of the spring 64 is then reattached to the unused leg 86 of retaining pin 82. In addition, the stop member 12 can be conveniently moved between the inoperative and operative positions by one person without the assistance of another person.

Although the present invention has been described with reference to preferred embodiments, workers skilled in the art will recognize that changes may be made in form and detail without departing from the spirit and scope of the invention.

What is claimed is:

1. A retractable stop assembly for use with a boom arm of the type configured to be raised and lowered by a lift cylinder having a body and an extensible rod, comprising:

a stop member;

a mounting assembly for attaching the stop member to the boom arm for movement between an inoperative position adjacent the boom arm and an operative position in which the stop member is engaged between a segment of the boom arm and a forward end of the lift cylinder body for preventing retraction of the lift cylinder; and, a biasing mechanism releasably securable between the boom arm and stop member for moving the stop member from the operative position to the inoperative position in response to an extension of the lift cylinder.

2. The retractable stop assembly of claim 1 wherein the stop member comprises a channel shaped element having a base portion and sidewalls extending outwardly therefrom for receiving the extensible rod therebetween in the operative position.

3. The retractable stop assembly of claim 2 wherein each sidewall includes an integral stop tab at a first end of the stop member for engaging a side edge of the forward end of the lift cylinder body in the operative position.

4. The retractable stop assembly of claim 3 wherein each sidewall further includes an integral stop ear at a second end of the stop member for engaging the boom arm segment in the operative position.

5. The retractable stop assembly of claim 1 wherein the mounting assembly comprises:

a retaining bolt mounted on the boom arm; and, a hook shaped extension integral with the stop member for engaging the retaining bolt, thereby mounting the stop member for pivotal and rectilinear movement.

6. The retractable stop assembly of claim 5 wherein the hook shaped extension includes a base portion, a first angled portion and a second angled portion, the first angled portion riding along the retaining bolt when the stop member is moved between the inoperative and operative positions.

7. The retractable stop assembly of claim 2 further including:

a clip assembly for securing the stop member in the inoperative position adjacent the boom arm, and alternately, in the operative position.

8. The retractable stop assembly of claim 7 wherein the clip assembly includes a U-shaped retaining pin having a bight portion and first and second legs extending outwardly therefrom.

9. The retractable stop assembly of claim 8 wherein the clip assembly further includes:

a first aperture extending through the stop member; and, a cooperating aperture extending through a portion of the boom arm, one of the legs of the retaining pin being engageable with the first and cooperating apertures for securing the stop member in the inoperative position.

10. The retractable stop assembly of claim 9 wherein the clip assembly further includes a second aperture extending through the stop member, one of the legs of the retaining pin being engageable with the second aperture for securing the stop member in the operative position.

11. The retractable stop assembly of claim 10 wherein the first and second aperture each comprise a pair of aligned apertures in the sidewalls of the stop member.

12. The retractable stop assembly of claim 10 wherein each leg of the retaining pin includes a resiliently biased ball detent for resisting dislodgement of the retaining pin from the apertures.

13. The retractable stop assembly of claim 1 wherein the biasing mechanism comprises:

a tension spring having a first end and a second end opposite the first end; and, a pivot mount for pivotally attaching the first end of the tension spring to the stop member to allow the tension spring to be rotated relative to the stop member.

14. The retractable stop assembly of claim 13 wherein the stop member includes a slot for releasably receiving the second end of the tension spring when the stop member is in the operative position.

15. The retractable stop assembly of claim 13 wherein the boom arm includes a cooperating aperture extending through a portion of the boom arm for releasably receiving the second end of the tension spring.

16. A boom stop for use with a vehicle frame of the type including a boom arm pivotally mounted thereto, and a fluid cylinder for raising and lowering the arm including a body pivotally mounted to the frame and an extensible rod pivotally mounted to the boom arm, comprising:

a stop member;

a mounting assembly for attaching the stop member to the boom arm for pivotal and rectilinear movement between an inoperative position wherein the stop member is generally parallel with the boom arm and an operative position wherein a first end of the stop member is engageable with a forward end of the cylinder body and a second end of the stop member is engageable with a portion of the boom arm for preventing retraction of the fluid cylinder;

a retaining pin for securing the stop member in the inoperative position and alternatively in the operative engaged position; and, a tension spring releasably securable between the boom arm and stop member for retracting the stop member from the operative position to the inoperative position in response to an extension of the fluid cylinder.

17. The boom stop of claim 16 wherein the mounting assembly comprises:

a retaining bolt mounted on the boom arm; and, a hook shaped extension integral with stop member for engaging the retaining bolt.

18. The boom stop of claim 16 wherein the stop member includes a first aperture and the boom arm includes a cooperating aperture, the retaining pin being engageable with the first and cooperating apertures for securing the stop member in the inoperative position.

19. The boom stop of claim 18 wherein the stop member includes a second aperture, the retaining pin being engageable with the second aperture for trapping the extensible rod within the stop member, thereby securing the stop member in the operative position.

20. The boom stop of claim 19 wherein the retaining pin includes a resiliently biased ball detent for resisting dislodgement of the pin from the apertures.

* * * * *